US005092249A

United States Patent [19]

Knuettel

[11] Patent Number: 5,092,249

[45] Date of Patent: Mar. 3, 1992

[54] ELECTRIC OVERHEAD TROLLEY SYSTEM WITH AUXILIARY RAIL AND DRIVEN AUXILIARY WHEEL FOR TRACTION

[75] Inventor: Werner Knuettel, Grosskrotzenburg, Fed. Rep. of Germany

[73] Assignee: Fredenhagen AG, Offenbach, Fed. Rep. of Germany

[21] Appl. No.: 729,840

[22] Filed: Jul. 12, 1991

Related U.S. Application Data

[63] Continuation of Ser. No. 480,659, Feb. 15, 1990, abandoned.

[30] Foreign Application Priority Data

Feb. 21, 1989 [DE] Fed. Rep. of Germany ..... 3905210

[51] Int. Cl.[5] ..... B61C 11/00

[52] U.S. Cl. ..... 105/30; 105/73; 105/150

[58] Field of Search ..... 104/89, 93, 121, 163, 104/165, 243; 105/30, 73, 75, 147, 150, 215.1

[56] References Cited

U.S. PATENT DOCUMENTS

| | | | |
|---|---|---|---|
| 399,997 | 3/1889 | Libbey | 105/147 |
| 1,375,726 | 4/1921 | Patton | 105/30 |
| 2,709,968 | 6/1955 | Cox | 105/30 |
| 3,254,608 | 6/1966 | Alden | 104/89 |
| 3,858,520 | 1/1975 | Patin | 104/89 |

FOREIGN PATENT DOCUMENTS

| | | | |
|---|---|---|---|
| 371131 | 2/1922 | Fed. Rep. of Germany | 105/147 |
| 474243 | 3/1929 | Fed. Rep. of Germany . | |
| 3439647 | 5/1986 | Fed. Rep. of Germany . | |
| 1323892 | 7/1973 | United Kingdom | 104/89 |

*Primary Examiner*—Robert J. Oberleitner
*Assistant Examiner*—S. Joseph Morano
*Attorney, Agent, or Firm*—Cushman, Darby & Cushman

[57] ABSTRACT

The invention proposes an electric overhead trolley system in which a travelling gear (14) is provided with a motor-driven driving wheel (16) and at least one auxiliary wheel (30) interacting with an auxiliary track (28), at least in certain sections, which auxiliary wheel contributes in transmitting the drive force to a track (10) so that ascending and decending track portions can be run through with less problems.

17 Claims, 5 Drawing Sheets

28
12
18
20
26
16
32
40
34
36
38
30
22
24
14
10

ELECTRIC OVERHEAD TROLLEY SYSTEM WITH AUXILIARY RAIL AND DRIVEN AUXILIARY WHEEL FOR TRACTION

This is a continuation of application Ser. No. 480,659, filed on Feb. 15, 1990, which was abandoned upon the filing hereof.

BACKGROUND OF THE INVENTION

The present invention relates to an electric overhead trolley system for conveying and positioning loads, having at least one motor-driven travelling gear adapted for being displaced along a track, a driving wheel supported on the track and at least one auxiliary wheel which influences the frictional engagement between the driving wheel and the track and which interacts with an auxiliary track extending in parallel to the track, at least along certain sections.

Electric overhead trolley systems—also known as single-track overhead conveyers—have been in use in production operations for transporting objects, which are to be processed or on which additional parts have to be mounted, between different locations within the production plant.

Each conveying unit may in this case consist of one, two or more travelling gears which may be interconnected by transverse girders on which the objects to be conveyed are hooked up and unhooked, respectively Compared with drag-chain conveyers, for example, such conveyers provide the advantage that each conveyer unit can be operated independently of the others. On the other hand, however, it is a disadvantage that such conveyers cannot overcome all gradients. Generally, the gradients which can be overcome, i.e. the so-called vertical lift, are limited to the range of 6 to 8 degrees.

This circumstance, namely that greater gradients cannot be overcome, is due to the fact that the conveyer is moved by frictional force so that in the event of greater gradients this frictional force will no longer suffice to overcome such gradient. In an effort to overcome this drawback, it has been proposed to arrange an auxiliary wheel below the conveyer track, which is preferably designed as an I beam, which auxiliary wheel then exerts an additional force on the driving wheel so as to increase the frictional force. As an alternative, DE-PS 474 243 suggests to arrange an auxiliary track above the conveyer track, which auxiliary track supports an auxiliary wheel mounted at one end of a double lever. The double lever can be pivoted about the axis of the driving wheels. Its other end carries an auxiliary counter-gear which acts to urge the driving wheels against the track.

In the case of these solutions, however, the driving force is still transmitted to the track only by the driving wheel. The auxiliary wheel does not in any way contribute to the transmission of the driving force. Instead, it only acts to increase the contact pressure of the driving wheel.

OBJECT OF THE INVENTION

Now, it is the object of the present invention to improve an electric overhead trolley system of the type described above in such a manner that the driving force is transmitted to the track not only by the driving wheel as such, but additionally also by the auxiliary wheel. This has the effect to increase the total driving force, while the contact pressure of each wheel remains unchanged. In addition, the frictional force is increased, preferably and to the extent necessary in those areas where a greater gradient has to be overcome in upward or downward direction, whereas no such increase is to occur outside these areas. All these features are to be achieved by simple constructional means.

This object is achieved by the fact that the auxiliary wheel is driven by the driving wheel, by frictional engagement, so that the auxiliary wheel can serve to transmit the driving force to the auxiliary track. The teachings according to the invention enable the forces to be divided between the driving wheel and the auxiliary wheel by simple constructional means, without any chains or the like of the type described by DE-PS 34 39 647, whereby it is rendered possible, in particular, to overcome even greater gradients without any problem and without increasing the contact pressure of the driving wheel.

The auxiliary track extends, preferably, along inclined track sections, but may be arranged also along horizontal track sections, especially where it is desired to stabilize the travelling gear, for example for transverse stacking purposes.

According to one embodiment of the invention, the shaft of the driving wheel may be equipped with connection elements receiving the shaft of the auxiliary wheel, which connection elements may be loaded by a force acting in the direction of the driving wheel which is exerted by a spring element mounted, either directly or indirectly, on a travelling gear frame carrying the driving wheel. Now, when the auxiliary wheel enters the region of an auxiliary track, whose distance to the main track must of course be smaller than the sum of the two diameters of the driving wheel and the auxiliary wheel, the spring element acts to pull the auxiliary wheel into the wedge-shaped gap opening up between the driving wheel and the auxiliary track, and consequently the contact pressure of the driving wheel will rise. When no auxiliary track is present and the spring element is in the fully retracted position, the driving wheel will be subjected only to the weight of the auxiliary wheel resting against the driving wheel. Consequently, no unnecessary energy losses will be caused by the drive of the auxiliary wheel. The connection elements may be designed as rigid elements or, preferably, as rocking arms. The latter design provides the advantage to ensure improved alignment of the shaft of the auxiliary wheel.

In the case of a rigid connection between the driving wheel and the auxiliary wheel the shaft of the auxiliary wheel is arranged in an oblong hole so that when entering the wedge-shaped gap between the auxiliary track and the driving wheel the auxiliary wheel can be displaced relative to the driving wheel a sufficient amount to achieve the necessary increase of the force of frictional engagement.

According to another preferred embodiment of the invention, two auxiliary wheels, which are connected with the driving wheel by means of rocking arms, are assigned to the driving wheel. This measure provides the advantage that the frictional engagement is increased in like manner, both on ascending and on descending track sections, so that uniform travelling conditions are achieved. If one auxiliary wheel is provided only, the disadvantage may arise that different contact pressures occur when travelling along ascending or descending track portions.

The presence of two auxiliary wheels provides a further, additional advantage. So, these wheels may serve for stabilizing the travelling gear in horizontal sections, for example during transverse stacking operations. For, in this case there always exists the risk of considerable instability of the travelling gear as the transverse girders interconnecting the individual travelling units do no longer extend in parallel to the track. Instead, each travelling gear runs on a different track. However, the greater the angular deviation between the transverse girder and the track becomes, the greater will be the instability of each travelling gear. Now, the presence of two auxiliary wheels provides an enlarged supporting surface and, accordingly, greater stability. To this end it is, however, necessary that the legs of the rocking arms projecting from the auxiliary wheels must come to rest against a stop and that an auxiliary track must be arranged in such a manner that it may get into contact with the auxiliary wheels and/or that it exhibits a small distance from the latter. Consequently, the distance of the auxiliary track must be smaller or greater, compared with that in descending or ascending areas. The difference is determined by the length occupied by the legs carrying the auxiliary wheels in the stop position or in the position in which the auxiliary wheels coact with the auxiliary tracks in the ascending or descending portion, with the spring element not in the fully retracted condition.

BRIEF DESCRIPTION OF THE DRAWING

Further details, advantages and features of the invention will appear not only from the claims and the features that can be derived therefrom—individually and/or in combination—, but also from the following description of certain preferred embodiments illustrated by the drawing, in which:

DESCRIPTION OF THE PREFERRED EMBODIMENTS

Figure 1:
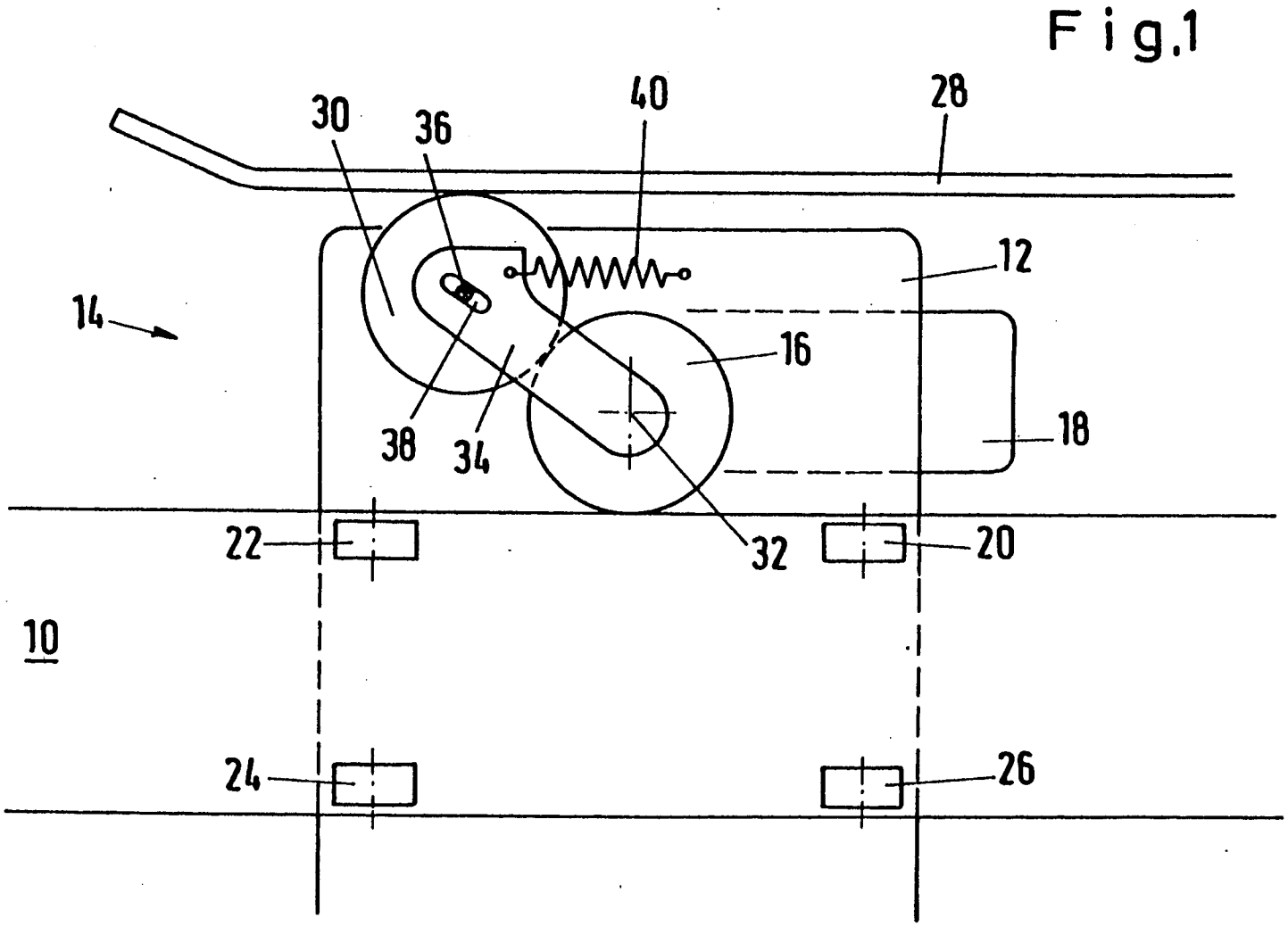
FIG. 1 shows a first embodiment of an electric overhead trolley system comprising a travelling gear provided with an auxiliary wheel.

The figures, in which similar elements are identified by the same reference numerals, show details of an electric overhead trolley system. A travelling gear (14) comprising a frame (12) is arranged to travel along a track (10) which may be constituted by an I beam. The travelling gear (14) comprises a driving wheel (16) which is in contact with the track (10) and Which can be driven by an electric motor (18). The frame (12) is provided with guide rollers (20, 22, 24 and 26) Which are supported by the lateral face of the flange of the track (10).

A transverse girder not shown n the drawing extends from the frame (12) and establishes the connection with another travelling-gear frame. The objects to be conveyed are then suspended on this transverse girder. In order to ensure the necessary frictional engagement of the driving wheel (16) in the area of the track sections exhibiting a rising or falling gradient, there are provided according to the invention an auxiliary track (28) and, on the other hand, at least one auxiliary wheel (30). The auxiliary track (28) extends along rising or falling track portions at a certain distance relative to the surface of the track (10), on which the driving wheel (16) is supported, this distance being smaller than the sum of the diameters of the wheels (16 and 30). A rigid connection element (34) projecting from the shaft (32) of the driving wheel (16) is provided with an oblong hole which is passed by the shaft (36) of the auxiliary wheel (30). In addition, the connection element (34) or the shaft 32 is equipped with a spring element (40) the other end of which is fixed on the frame (12). This spring exercises upon the connection element (34) a force acting in the direction of the driving wheel (16). Now, when the auxiliary wheel (30) enters the wedge-shaped gap formed between the auxiliary track (28) and the driving wheel, the frictional engagement between the auxiliary wheel (30) and the driving wheel (16) increases with the result that the frictional engagement relative to the track (10) rises and a contact pressure is produced between the auxiliary wheel (30) and the auxiliary track (28) so that, consequently, the latter's gradient in upward or downward direction can be overcome without any problem.

Figure 2:
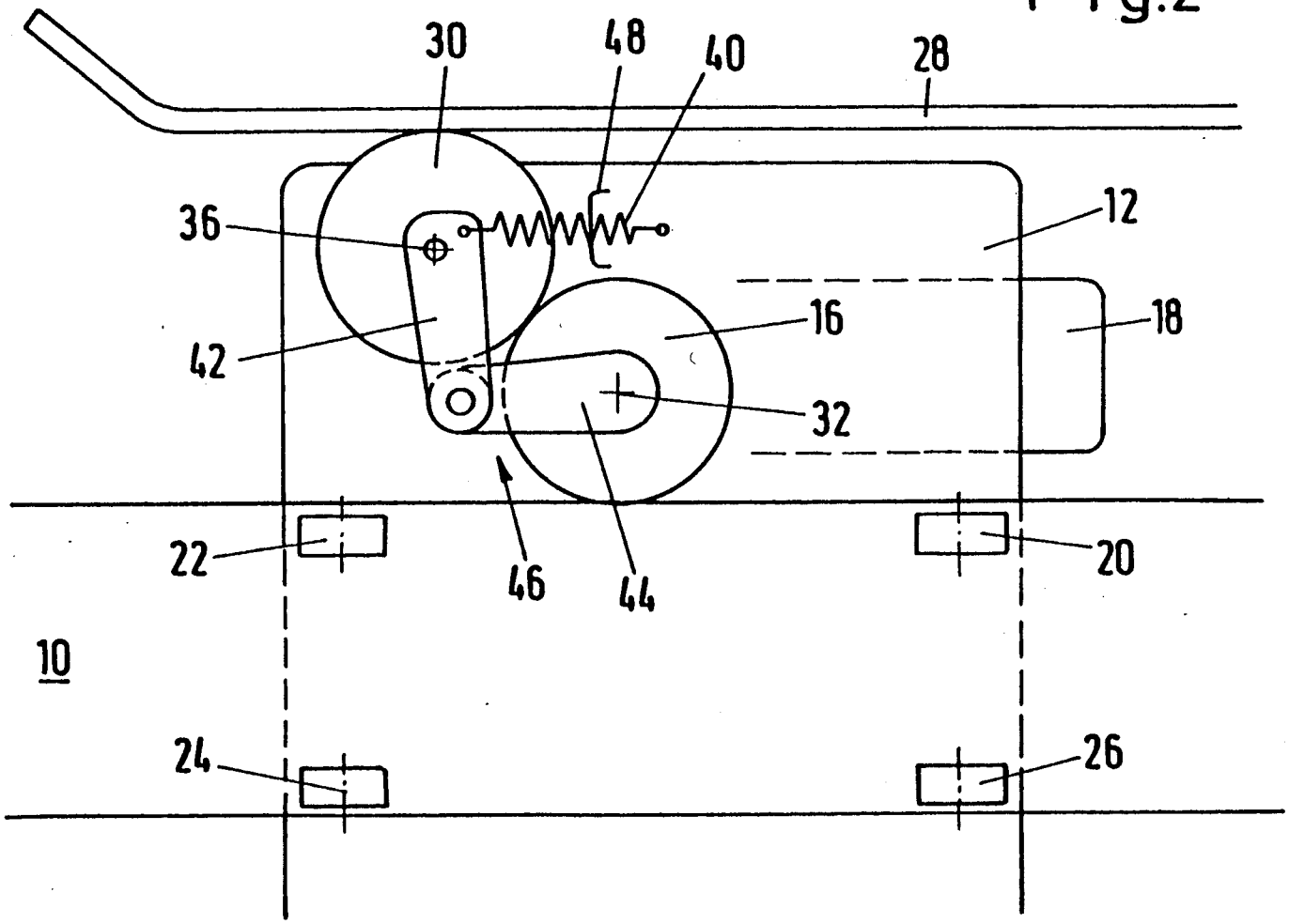
FIG. 2 shows a second embodiment.

In the arrangement illustrated in FIG. 2, the driving wheel (16) is connected with the auxiliary wheel (30) by means of rocking arms (46) consisting of legs (42) and (44) which are articulated relative to each other. For the rest, the elements are identical with those described with reference to FIG. 1. It need not be stressed particularly that one of the rocking arms (46) is provided on each side of the wheels. This type of connection provides improved alignment of the shaft of the auxiliary wheel.

Figure 5:
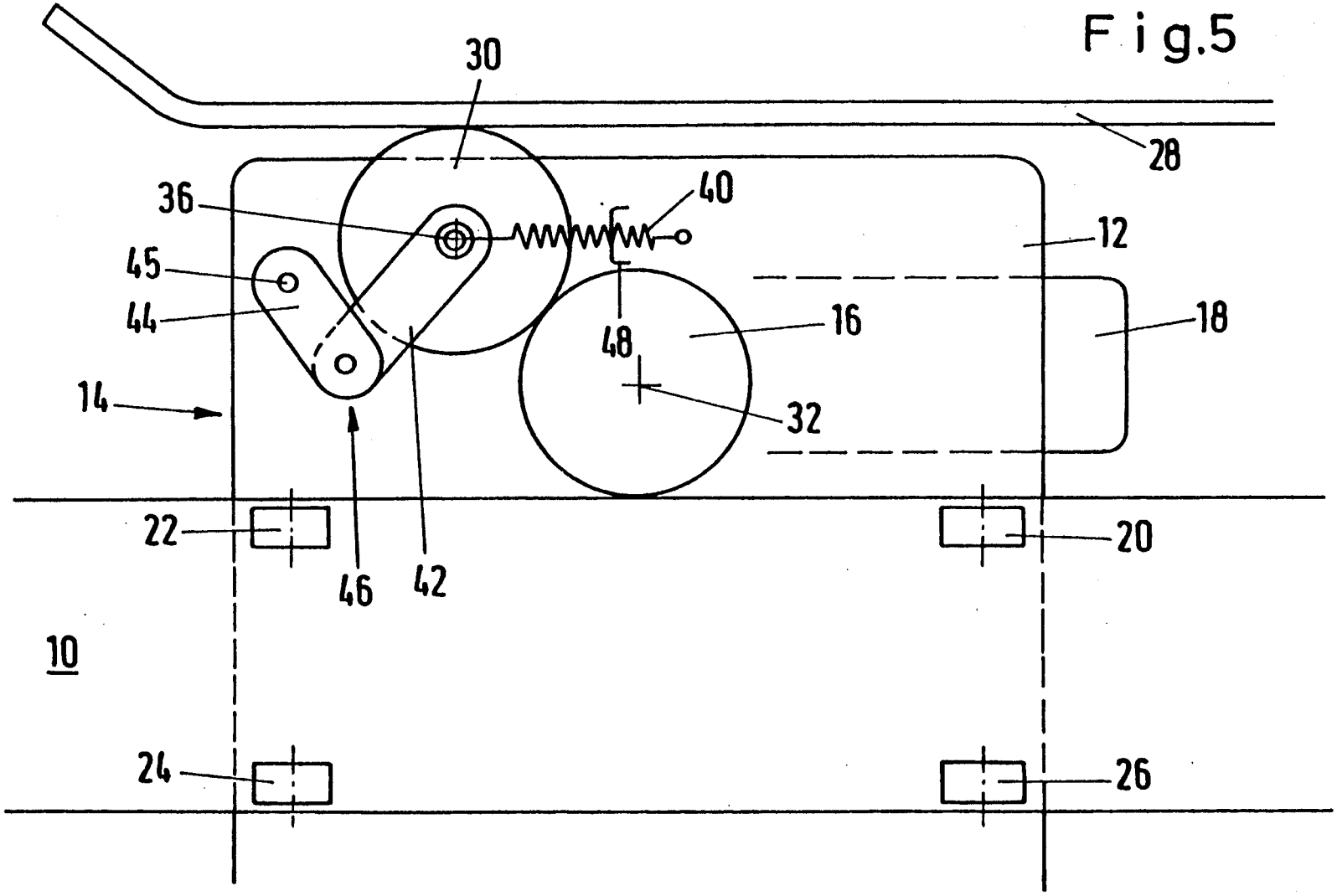
FIG. 5 shows a particularly preferred embodiment of the invention.

Contrary to the above arrangement, the rocking arm (46) illustrated in FIG. 5 and comprising the legs (42) and (44) is not connected to the frame (12) at its shaft (32), but rather at a point (45) opposite the same. The pivot point (45) of the rocking arm (46) is located outside the wheel (16) and the auxiliary wheel (30). The particular arrangement of the rocking arm (46) and its pivot point (45) leads to a particularly simple constructional solution.

Figure 3:
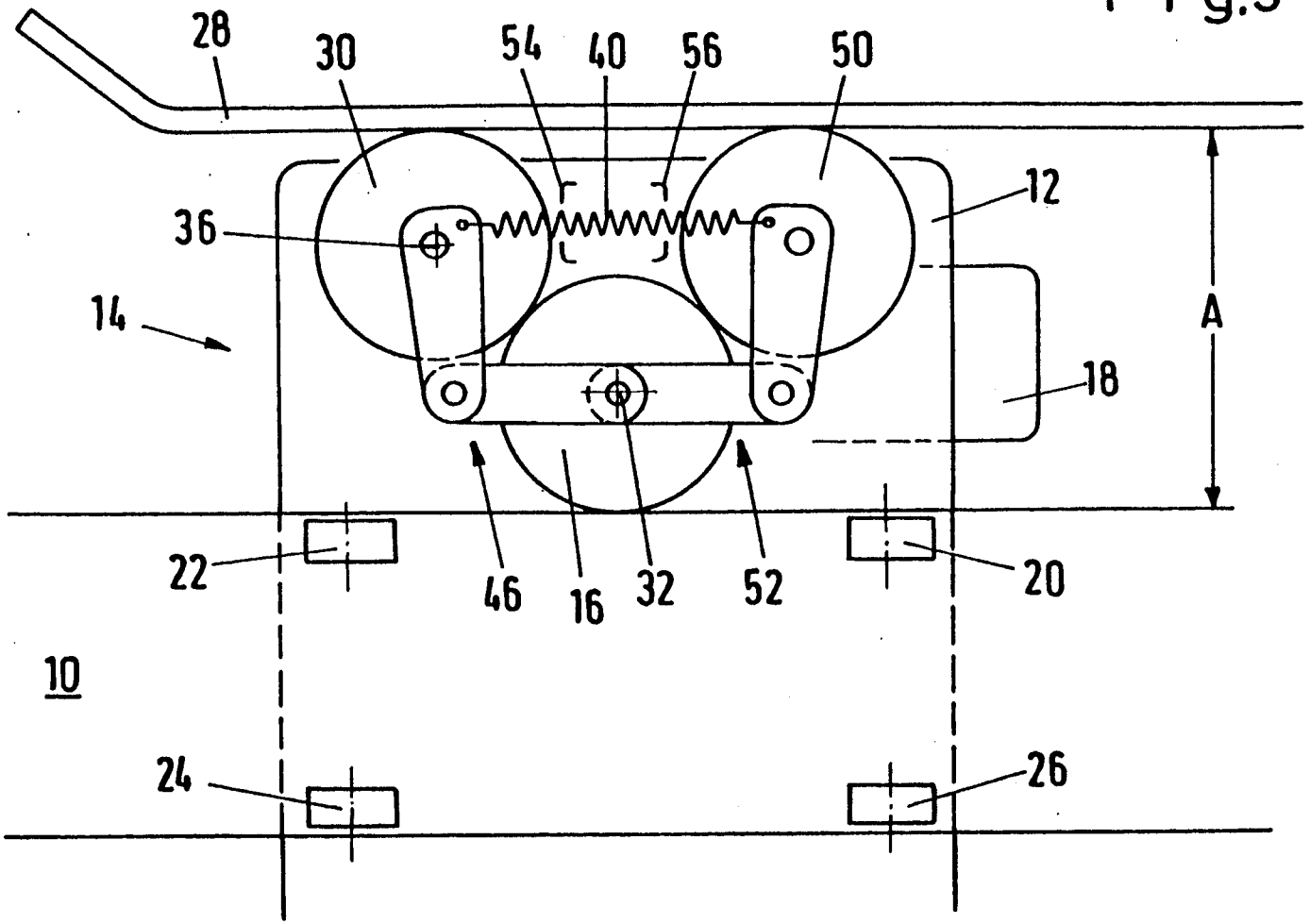
FIG. 3 shows a third embodiment.

According to FIG. 3, two auxiliary wheels (30) and (50), instead of only one auxiliary wheel, may be provided and assigned to the driving wheel (16) so that the contact pressure acting on the track (10) is increased by the frictional engagement between such wheels, and a surface pressure acting on the auxiliary track (28) is produced. Each of the auxiliary wheels (30) and (50) is connected with the shaft (32) of the driving wheel (16) by a rocking arm (46) and (52), respectively. The rocking arm (46) and (52) may be interconnected by a spring element. But there is of course also the possibility to connect each of the rocking arms (46) and (52) to a separate spring element extending directly or indirectly from the travelling-gear frame (12), or to mount the spring elements directly or indirectly on the shafts (36) of the auxiliary wheels. The arrangement of two auxiliary wheels (30) and (50) provides the advantage that the frictional engagement of the driving wheel (16) and the frictional engagement of the auxiliary track are increased equally on both, rising and dropping track portions. The increase of the frictional force is achieved in this manner either by the auxiliary wheel (30) or the auxiliary wheel (50), depending on the direction of the driving or braking force.

However, the presence of two auxiliary wheels (30) and (50) provides still another important advantage which will be described hereafter with reference to FIG. 4.

In the case of the embodiments illustrated in FIGS. 2 and 3, the distance between the track (10) and the auxiliary track (28), which is designated by A in FIG. 3, has been selected in such a manner that the spring elements are not in the fully retracted condition, which means that the connection elements mounted on the auxiliary wheels (30) and (50), respectively, are not in contact with the stop (48) in FIGS. (2) and (5), or the stops (54) and (56) in FIG. 3. Consequently, the auxiliary wheels (30) are pulled into the wedge-shaped gap formed between the auxiliary track (28) and the driving wheel (16), and this—as has been mentioned before—increases the force of frictional engagement between the auxiliary wheels (30) and (50), respectively, and the driving wheel (16) and produces the contact pressure of the auxiliary track.

Figure 4:
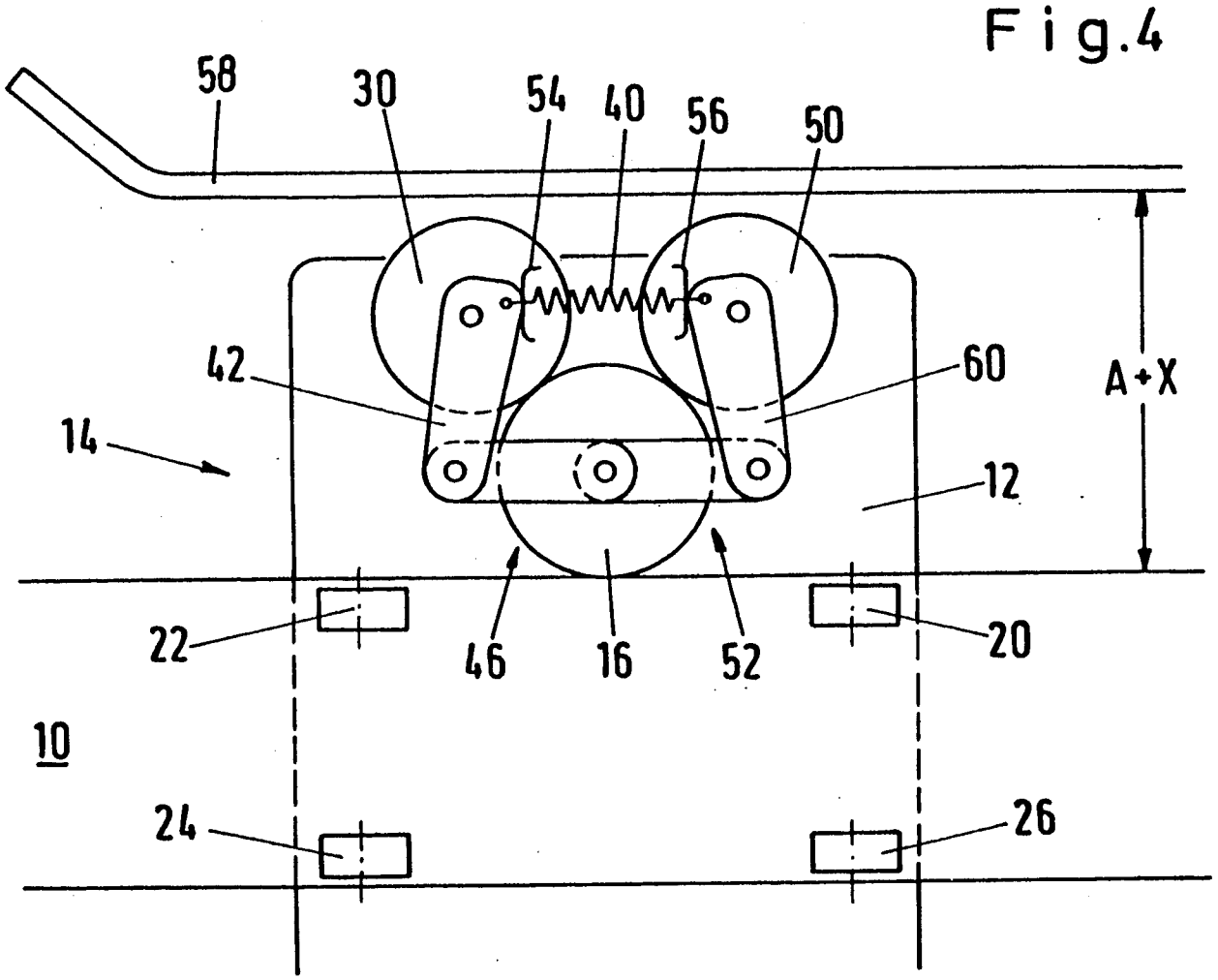
FIG. 4 shows a variant of the embodiment illustrated in FIG. 3.

In FIG. 4, an additional auxiliary track (58) is assigned to the track (10) in a horizontal portion of the track, for example in an area where transverse stacking is to take place. However, the distance between the auxiliary track (58) and the track (10) has been selected in such a way that the legs (42) and (60), respectively, of the rocking arms (46) and (52) bear against the stops (54) and (56), respectively. Consequently, the spacing of the auxiliary track (58) is greater by an amount X than the distance A in figs. 1 to 3. The spacing may be selected in such a way that when the legs (42) and (60) bear against the stops (54) and (56), respectively, the auxiliary wheels (30) and (50) are in contact with the bottom face of the auxiliary tracks (58), or extend at a small distance relative thereto. In this position, additional stability is provided for the travelling gear (14) by the auxiliary wheels (30) and (50). whereby the desired stability is ensured for the whole conveyer system, which comprises at least two travelling gears running on different tracks (10), and this even during transverse stacking operations. But even if the system were equipped with a single travelling gear only, the arrangement of auxiliary wheels (30) and (50), together with the existing auxiliary track (58), would also ensure the necessary stability.

The auxiliary track (58) may also extend at a smaller distance from the track (10), compared with the auxiliary track (28) which acts to increase the frictional engagement, the decisive points being that on the one hand the spring elements must be in the fully retracted condition and, on the other hand, the auxiliary wheels must project beyond the driving wheel, in upward direction.

I claim:

1. An electric overhead trolley system for conveying and positioning loads, comprising:

a plurality of conveying units, each unit including at least one motor-driven travelling gear adapted for attaching to objects and being displaced along a track, a driving wheel supported on the track;

at least one auxiliary wheel which interacts with an auxiliary track extending in parallel to at least a portion of the track, and which is frictionally driven by said driving wheel through direct contact with said driving wheel so that driving forces for displacing said conveying unit are divided between said driving wheel and said auxiliary wheel.

2. An electric overhead trolley system according to claim 1, wherein connection elements receiving a shaft on the said auxiliary wheel are mounted at a point which connection elements may be loaded by a force exerted int he direction of the said driving wheel and the said auxiliary track, by spring elements mounted on said travelling gear frame carrying the said driving wheel.

3. An electric overhead trolley system for conveying and positioning loads, having at least one motor-driven travelling gear adapted for being displaced along a track, a driving wheel supported on the track and at least one auxiliary wheel which influences frictional engagement between the driving wheel and the track and which interacts with an auxiliary track extending in parallel to the track, at least along certain sections, wherein the said auxiliary wheel is driven by the said driving wheel by frictional engagement,; wherein connection elements receiving a shaft of the said auxiliary wheel are mounted at a point which connection elements may be loaded by a force exerted in the direction of the said driving wheel and the said auxiliary track, by spring elements mounted on said travelling gear frame carrying the said driving wheel, and wherein said connection elements receiving said shaft of the said auxiliary wheel are mounted on said shaft of said driving wheel, and there ar at least one of said spring elements mounted directly on said shafts to exert a force on the said auxiliary wheels in the direction of said driving wheel and said auxiliary track.

4. An electric overhead trolley system according to claim 2 or 3, wherein the said connection elements are rocking arms.

5. An electric overhead trolley system according to claim 2, wherein the said connection elements are designed as rigid legs (34) and the said shaft of the said auxiliary wheel (38) is arranged in an oblong hole (38) for displacement therein.

6. An electric overhead trolley system according to claim 2 or 3, wherein a leg mounted on the said auxiliary wheel of a rocking arm coacts with stops in the direction of the force exerted by the said spring element.

7. An electric overhead trolley system according to claim 6, wherein two auxiliary wheels, which are connected with the said driving wheel by means of rocking arms, are driven by the said driving wheel.

8. An electric overhead trolley system according to claim 7 wherein legs connected with the said auxiliary wheels of the said rocking arms coact with said stops in the direction of the forces exerted by the said spring element.

9. An electric overhead trolley system according to claim 8, wherein for stabilizing the said travelling gear when the said legs rest against the said stops, a further auxiliary track extends above the said auxiliary wheels, said further auxiliary track being adjacent the auxiliary wheels.

10. A system as in claim 9 wherein said further auxiliary track is contacted by the auxiliary wheels.

11. A system as in claim 9 wherein the auxiliary wheels are a slight distance from the auxiliary track.

12. An electric overhead trolley system according to claim 7, wherein the said auxiliary track extends along inclining track portions of the said electric overhead trolley system.

13. A system as in claim 2 wherein said connection elements are mounted on a shaft of the driving wheel.

14. A system as in claim 2 wherein said connection elements are mounted at a point of the travelling gear frame.

15. A system as in claim 2 wherein said spring elements are mounted directly on said travelling gear frame.

16. A system as in claim 2 wherein said spring elements are mounted indirectly on said traveling gear frame.

17. An electric overhead trolley system for conveying and positioning loads, comprising:

a plurality of conveying units, each unit including at least one motor-driven travelling gear adapted for attaching to object and being displaced along a track;

a driving wheel supported on the track;

at least one auxiliary wheel which interacts with an auxiliary track extending in parallel to at least a portion of the track, and which is frictionally driven by said driving wheel through direct contact with said driving wheel so that driving forces for displacing said conveying unit are divided between said driving wheel and said auxiliary wheel; and a least one rocking arm, receiving a shaft of said auxiliary wheel, mounted at a point which said at least one rocking arm may be loaded by a force exerted in the direction of said driving wheel and the said auxiliary track by spring elements mounted on said travelling gear frame carrying said driving wheel.

* * * * *